US008671526B2

(12) United States Patent
Jeter, Jr.

(10) Patent No.: US 8,671,526 B2
(45) Date of Patent: Mar. 18, 2014

(54) STRING COVERING APPARATUS

(75) Inventor: Perry Jeter, Jr., Morgantown, WV (US)

(73) Assignee: Jet 21, Inc., Westerville, OH (US)

( * ) Notice: Subject to any disclaimer, the term of this patent is extended or adjusted under 35 U.S.C. 154(b) by 884 days.

(21) Appl. No.: 12/313,145

(22) Filed: Nov. 17, 2008

(65) Prior Publication Data

US 2010/0122441 A1 May 20, 2010

(51) Int. Cl.
*A43C 7/00* (2006.01)
*F16G 11/00* (2006.01)

(52) U.S. Cl.
USPC .... 24/129 R; 24/129 D; 24/129 B; 24/115 H; 24/130

(58) Field of Classification Search
USPC ..... 24/18, 30.5 S, 66.9, 712, 712.1, 712.2, 24/712.5, 712.7, 712.9, 129 R, 130, 129 B, 24/129 D, 115 H, 114.7, 114.5, 198–200, 24/713, 713.1; 40/316, 636, 673, 606.11, 40/617, 640, 623; 16/428; 36/136; 2/171.4, 235, 96
See application file for complete search history.

(56) References Cited

U.S. PATENT DOCUMENTS

| | | | | | |
|---|---|---|---|---|---|
| 1,462,220 | A | * | 7/1923 | Wiegandt | 40/673 |
| 1,563,371 | A | * | 12/1925 | Jones | 40/316 |
| 1,622,324 | A | * | 3/1927 | Lettre | 24/129 B |
| 1,806,162 | A | * | 5/1931 | Hahn | 24/712.6 |
| 4,049,357 | A | | 9/1977 | Hamisch, Jr. | |
| 4,384,418 | A | * | 5/1983 | Alley | 40/651 |
| 4,539,767 | A | * | 9/1985 | Jaffe | 40/316 |
| 4,724,584 | A | | 2/1988 | Kasai | |
| 4,912,814 | A | | 4/1990 | McKenzie | |
| 5,323,514 | A | | 6/1994 | Masuda et al. | |
| 5,737,808 | A | | 4/1998 | Ikeda | |
| 5,752,687 | A | * | 5/1998 | Lynch | 248/311.2 |
| D404,770 | S | * | 1/1999 | Meade et al. | D20/24 |
| 5,979,028 | A | * | 11/1999 | Hicks et al. | 24/712.9 |
| 6,434,870 | B1 | * | 8/2002 | Fanjoy | 40/636 |
| 6,938,308 | B2 | | 9/2005 | Funk | |
| 7,073,282 | B2 | * | 7/2006 | Savagian et al. | 40/316 |
| 7,140,078 | B2 | | 11/2006 | Watabe | |
| 7,150,757 | B2 | * | 12/2006 | Fallin et al. | 606/232 |
| 2005/0183245 | A1 | * | 8/2005 | Whipple | 24/129 R |
| 2008/0034555 | A1 | | 2/2008 | Cheng | |
| 2008/0083134 | A1 | * | 4/2008 | Lin | 36/50.1 |
| 2008/0086917 | A1 | * | 4/2008 | Carrillo | 36/136 |

FOREIGN PATENT DOCUMENTS

| | | | | |
|---|---|---|---|---|
| GB | 2060373 A | * | 5/1981 | |
| GB | 2147937 A | * | 5/1985 | F16G 11/00 |
| WO | WO 2008026834 A1 | * | 3/2008 | |

* cited by examiner

*Primary Examiner* — Robert J Sandy
(74) *Attorney, Agent, or Firm* — Jason H. Foster; Kremblas & Foster

(57) ABSTRACT

Drawstrings or cords of clothing or non-clothing items such as carrying apparatuses are prevented from receding and being lost in the item by providing a flexible string covering apparatus through which strings or cords are passed. A central body region of a string covering apparatus is adorned with a team logo, company emblem, or the like, and aperture regions are arranged on opposite ends of the central body region in which to thread the string or cord. The thermoplastic composition material and the shape of apertures within the aperture regions prevent the string covering apparatus from sliding, allowing the user or maker of the string covering apparatus to display a desired image unobstructed by the string or cord.

7 Claims, 6 Drawing Sheets

STRING COVERING APPARATUS

FIELD OF THE INVENTION

This invention relates to apparatuses attached to stringed items or items that use strings or cords for functional or decorative purposes, for example, clothing such as sweatpants, shorts, hoods, jackets or non-clothing items such as backpacks, luggage, tote bags, laundry bags or other apparatuses that have exposed strings or cords. The string covering prevents the string from being lost or receded into the garment or carrying item while simultaneously displaying a logo, emblem or desired design.

BACKGROUND OF THE INVENTION

Drawstrings and cords are used extensively on various items such as, for example, articles of clothing, sporting goods, back packs and other apparatuses that have strings or cords for functional, fashion, or decorative purposes. For example, hoods on jackets, sweatshirts and other garments commonly are provided with drawstrings or cords, allowing the hood to be cinched around the face or neck of the wearer. Clothing such as sweat pants, regular pants, shorts, swim trunks and the like commonly use drawstrings incorporated into a garment's waist band, allowing the garment to be drawn around a wearer's waist. On luggage, backpacks and other gear, drawstrings and cords are used to fasten pockets and other openings.

With continued use, drawstrings and cords tend to shift so that one or both ends of the string will retract into a garment or carrying item, thus being unavailable for the user to implement when needed. Often users will try to tie a knot in the string to prevent string loss, but such knots can be small and do not prevent the string from receding into a garment or carrying item. Also, knotted strings or strings by themselves do not provide adequate surface area to display decorative team logos or company emblems on the string or cord.

To overcome the difficulties associated with drawstrings receding into a clothing garment or retracting into a piece of luggage, backpack, or sportspack, prior art devices such as cord locks or lace locks have been devised. Masuda et al (U.S. Pat. No. 5,323,514) discloses a cord stopper with multiple rigid plastic interlocking parts including an insert member 12 and cylindrical housing 10. The device further comprises rigid coil springs 26 and 42, circular head 24, circular bottom lid 14, circular platform 30, all which add to the complexity of the device. In order to secure a string or cord within this device, the user must firmly squeeze and hold the cord stopper, and thread the string through, release the grip, which binds the cord thereto. While this device is able to fasten to the string, the strong springs and hard plastic can sometimes work to clinch down and damage a soft drawstring or cord. Since the cord stopper and similar devices are spring loaded, the devices work only until the string softens or hardens through multiple use, or until the spring falls out. If they come off the string, most designs fall apart because the string lets go, or one of the pieces comes off, rendering the device unusable. Moreover, the multiple parts needed to construct this device add to the manufacturing cost and manufacturing time. Lastly, the small cylindrical surface area of the cord stopper does not allow a user or maker of the device to adequately display a team or company logo or emblem on one flat surface.

Several devices have been patented which aim to secure the laces for athletic shoes. Funk (U.S. Pat. No. 6,938,308 B2) discloses a lace securing and adjusting device including a body 12 and apertures 14 and 14' that are positioned laterally on opposite sides of a center aperture 16. Hicks et al (U.S. Pat. No. 5,979,028) discloses a shoe lace clip 30 with holes 40 and 42 to pass both shoelaces through and slots 50 and 52 that extend into the middle of the clip which are used to increase the holding pressure on the lace ends 16 and 18. While these devices are designed to thread both laces through the middle and end apertures and slots in elaborate patterns which enable the user to secure the devices in place so as to prevent the shoelaces from being undone, the surface area taken up by the multiple apertures, slots and the laces that cover the front of the apparatuses do not allow a maker of the device or user to adequately display a wide variety and sizes of team logos or company emblem as are known in the marketplace.

What is needed in the art is a string covering apparatus of simple design comprising relatively few parts that can be attached to a string or cord to prevent the string from getting lost, while also providing space to identify the source or labeling to the user or the owner of the apparatus.

SUMMARY OF THE INVENTION

The present invention therefore provides a string covering apparatus for preventing loss of a string on a clothing, non-clothing, or carrying item wherein the apparatus provides ample space for the displaying of a full range of team logos, company names, emblems and the like. The apparatus may be constructed in a variety of sizes and materials which can comprise a perimeter, front and back surfaces, a central body region, and outer aperture regions on opposite sides of the central body region. The aperture regions are positioned to pass a string or cord along the back surface of the central body region, leaving the front surface comprising the central body region unobstructed by the string or cord, allowing full display of a design feature area on the central body region. The perimeter may take on various shapes such as an oval, circle, irregular shaped curved pattern, or in the shape of a team mascot, company logo, or other custom design. The string covering apparatus is preferably made of a thermoplastic such as PVC or ABS, but may be made of comparable materials, or other flexible plastics. Since the string or cord is passed along the back central body region of the string covering apparatus, the design leaves the front central body region unobstructed, for the adequate display of a large array of team logos or company emblems to be formed thereon. Features which may make up the logos or emblems may be permanently decorated with molded features, may be printed or stamped, or may be adhered to with stickers or others temporary measures which allow a user to use the string covering apparatus to represent many different teams, and to re-use the apparatus, thus making the apparatus more versatile.

The invention allows users to further personalize and customize their sweatshirts, athletic wear, athletic bags and accessories, and allows companies to promote and market a particular logo, and helps prevent string loss, which is a frustrating and time consuming problem when dealing with stringed clothing.

DETAILED DESCRIPTION OF THE PREFERRED EMBODIMENT

Figure 1:
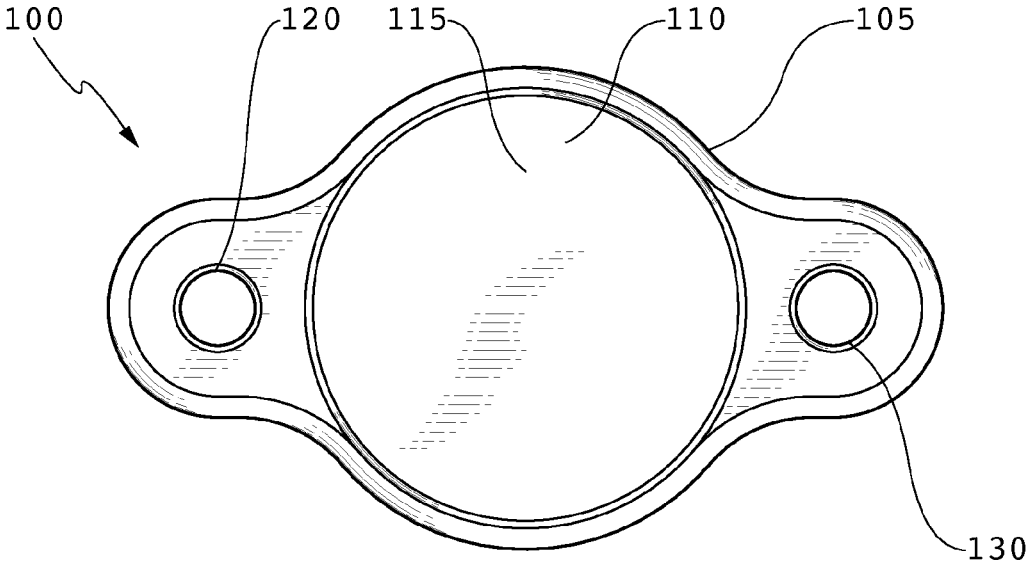
FIG. 1 is a top view of a string covering of the present invention.
Figure 1A:
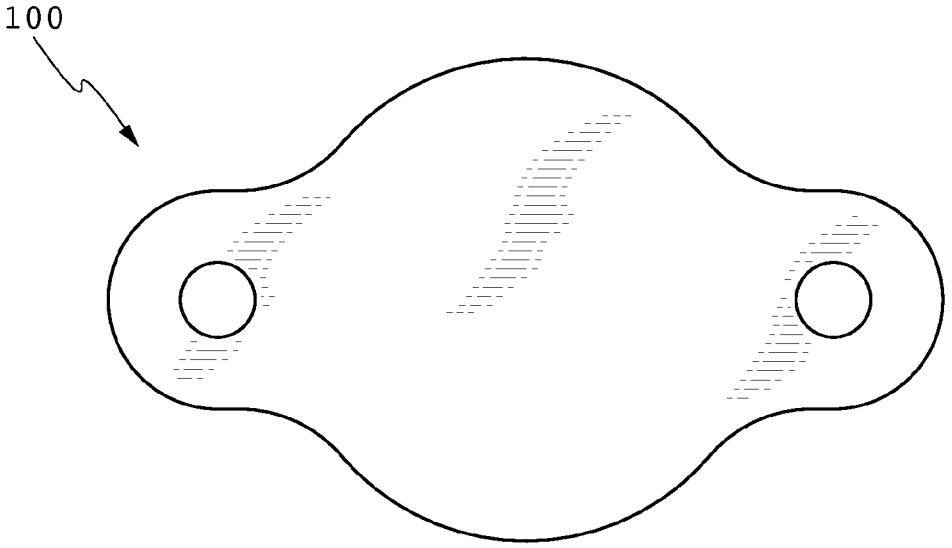
FIG. 1A is bottom view of the string covering shown in FIG. 1.

Reference will now be made to the embodiments of the present invention, examples of which are illustrated in the accompanying drawings, wherein like reference numerals refer to the like elements throughout. The embodiments are described below in order to explain the present invention while referring to the figures.

Referring now more specifically to the drawings and to FIG. 1 in particular, an example of a string covering apparatus 100 embodying certain aspects of the present invention is shown. The string covering apparatus 100 may be constructed in a variety of different embodiments and may be used in connection with a variety of different items. String covering apparatus 100 can be attached to a string or cord (not shown), for example, on an article of clothing such as a jacket, a hood, a waistband or any other article of clothing that uses a drawstring or cord for functional, ornamental, or fashionable wear. The string covering apparatus 100 may also be used on non-clothing items such as luggage, tote bags, backpacks, laundry bags, or other items that also use a drawstring or cord for function or fashion. Although several specific embodiments are described herein, it will be apparent that the invention is not limited to the embodiments illustrated, as minor modifications may be made which do not deviate or differentiate from the essence of the inventions being presented herein.

Figure 2:
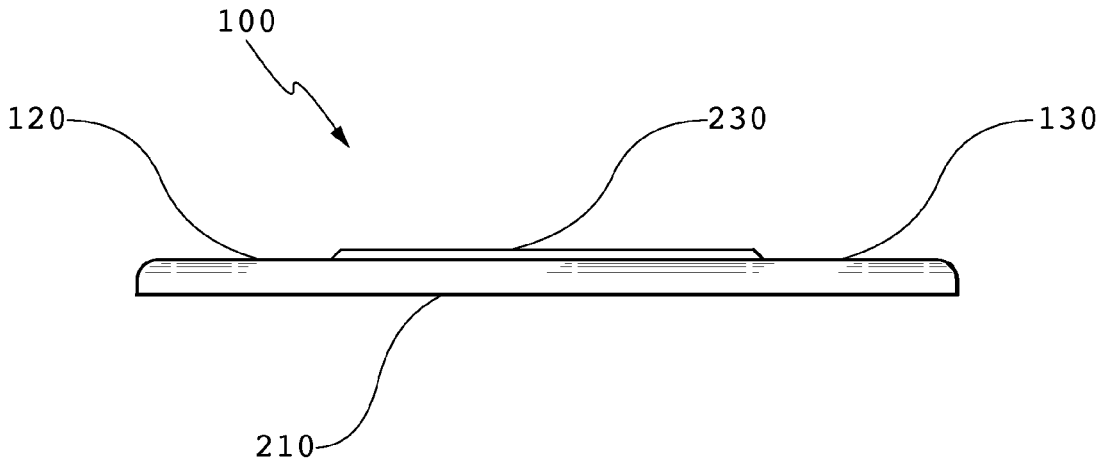
FIG. 2 is a side view of the string covering apparatus showing the thickness of the apparatus and height of the raised logo features.
Figure 2A:
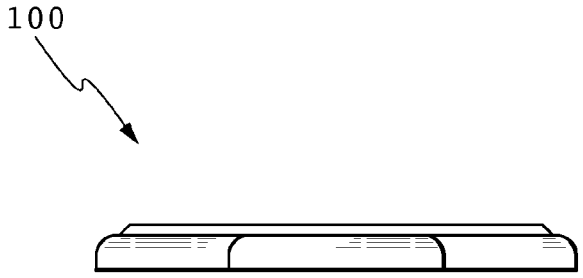
FIG. 2A is an end view of the string covering shown in FIG. 1.
Figure 3:
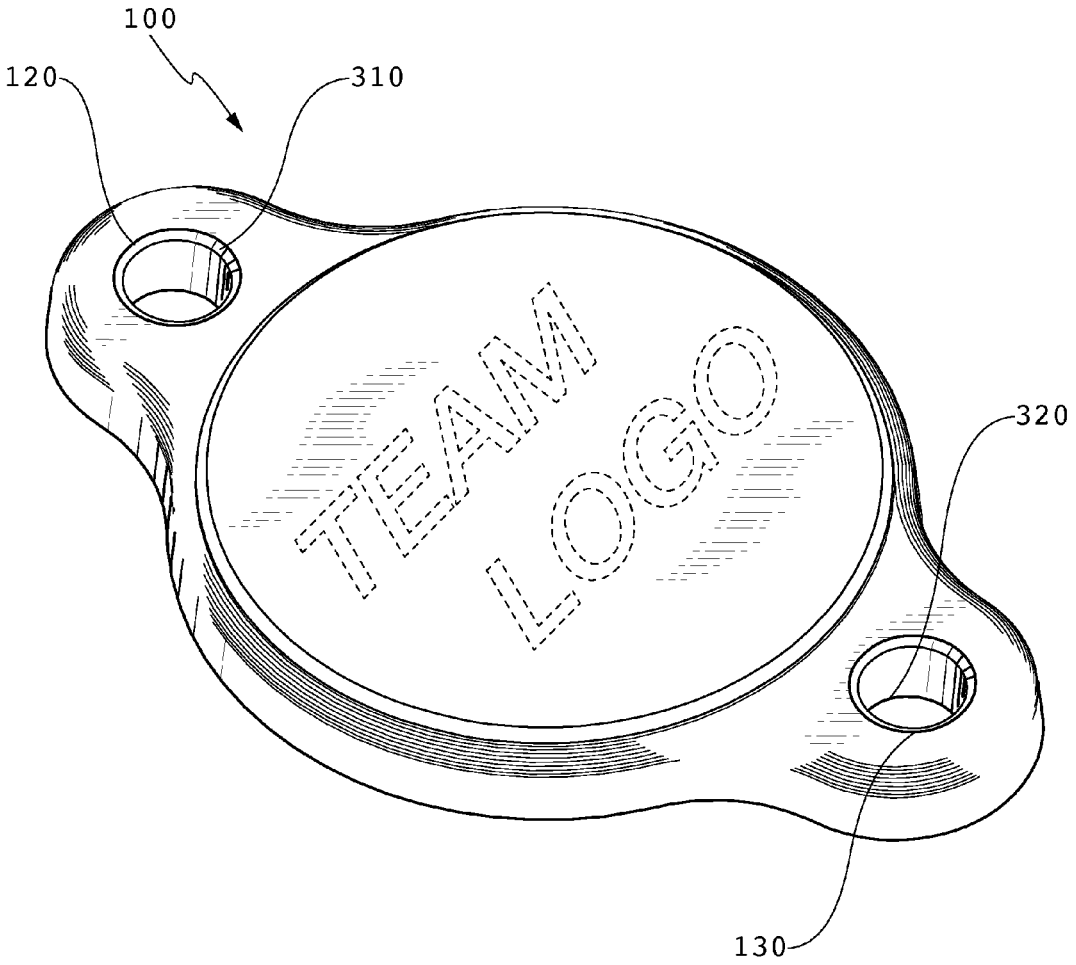
FIG. 3 is a three-dimensional view of the string covering apparatus showing the curved surface of the aperture region opening.

The preferred embodiment of the present invention is shown in FIGS. 1-3 and is described below. As shown in FIGS. 1 and 2, the string covering apparatus 100 comprises a perimeter 105, a central body region 110, wherein the central body region 110 comprises a front surface 115 and a back surface 210. The front surface 115 of the central body region 110 is used to form logo features or other desired insignia of teams or companies that are unobstructed by the strings or cords. The string covering apparatus 100 further comprises a first aperture region 120 positioned adjacent the central body region 110 and a second aperture region 130 positioned opposite the central body region 110 from the first aperture region 120. In the preferred embodiment, the first and second aperture regions 120 and 130 protrude out from the central body region 110 and are not a part of the central body region.

FIG. 2 shows a side view of the string covering apparatus 100. Formed on the front surface 115 of the central body region 110 is a design feature area 230. The design feature area 230 may comprise designs using several different forms, such as molded features, printed or stamped features, or stickers, for example. When the design feature area 230 uses molded features, the features will add to the height of the string covering apparatus 100, as shown in FIG. 2. When design features are printed or stuck on, the height will of the string covering apparatus 100 will remain relatively the height of the central body region 110 without the raised molded features. The back surface 210 is the surface that the string or cord (not shown) will pass along when being passed though the aperture regions 120 and 130, therefore allowing the front surface of the central body region comprising the design feature area 230 to remain unobstructed by the string or cord, to fully display the desired design. The string covering apparatus 100 preferably has a thickness between 0.08 inches and 0.2 inches, but may be adjusted thinner or thicker depending on the size of the apparatus to be attached to or the size of the string or cord. The length of the string covering apparatus preferably is between 1.2 inches to 2.0 inches long and the width preferably between 1.0 and 1.5 inches. However, both the length and width of the string covering apparatus may be adjusted for the particular use of the user. When the design features are molded, the design features preferably fall within the range of 0.015 inches to 0.030 inches, but also may be made thinner or thicker depending on the size of the string covering apparatus.

FIG. 3 shows a three-dimensional view of string covering apparatus 100. The string covering apparatus 100 is preferably made of a flexible thermoplastic material. PVC, rubberized PVC, and ABS are examples of preferred materials, but the string covering apparatus 100 is not limited to these materials, and encompasses known equivalents. During manufacture, the aperture regions 120 and 130 are cut into the mold so that the string covering apparatus comes out complete. Preferably, the string covering apparatus 100 comprises rounded or curved edges 310 at the area that the aperture regions 120 and 130 approach the front surface 115. On the back surface 210 of the string covering apparatus 100, the interface area between the back surface 210 and the aperture regions 120, 130 are not smoothly curved, but rather define a more sharp edge 320. The rounded or curved edges 310 near the front surface 115 allow the string covering apparatus 100 to be readily adjusted along a string or cord, while the sharp edges 320 near the back surface 210 prevents the string covering apparatus 100 from sliding out of position during use.

Figure 4:
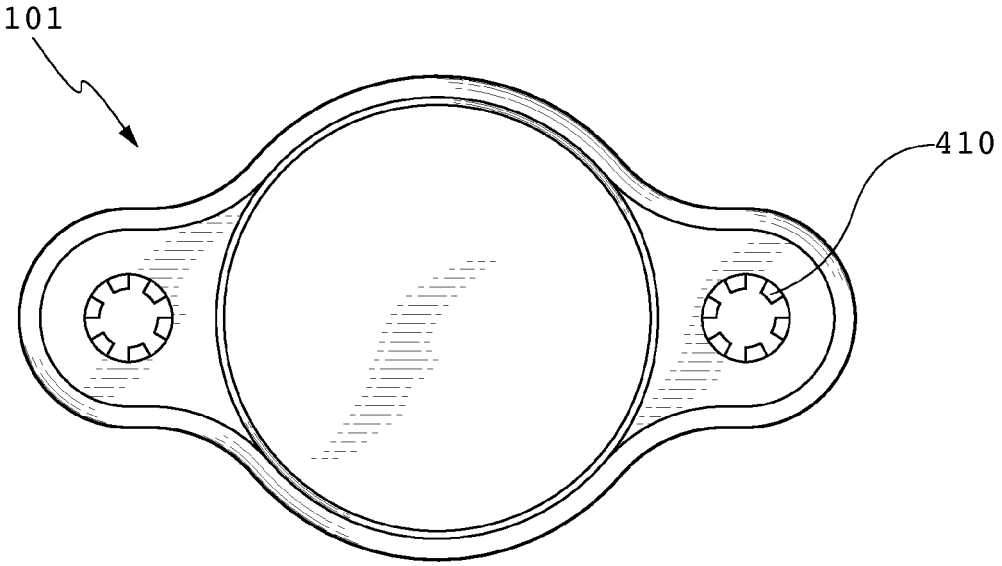
FIG. 4 is a top view of an alternate embodiment of the present invention.
Figure 4A:
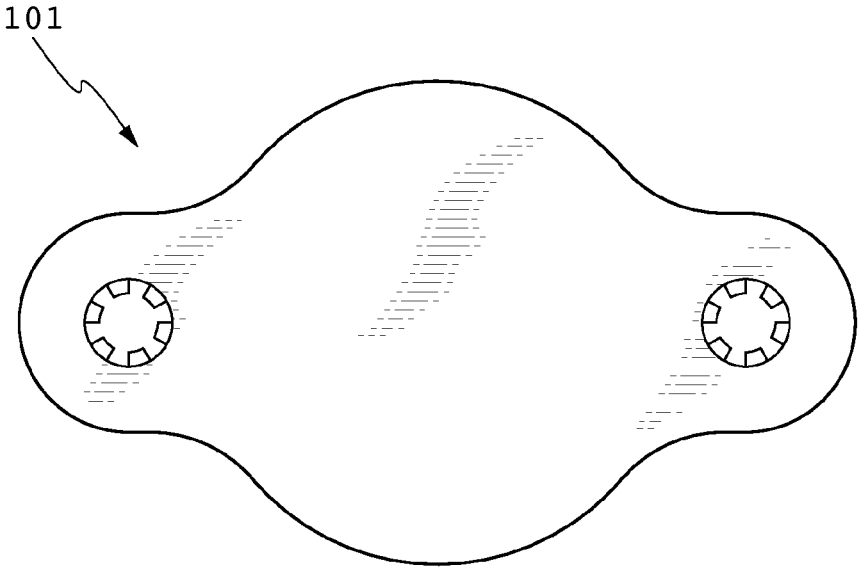
FIG. 4A is bottom view of the string covering embodiment shown in FIG. 4.

In the preferred embodiment, circular apertures within the aperture regions 120, 130 preferably have a diameter of 0.10 inches to 0.20 inches, but may be made smaller or larger depending on the size of the string or application. Apertures within the aperture regions 120, 130 may also be made of different geometric shapes such as oval, triangular, square, or other polygon or geometric shape, depending on the desired design. Because the aperture regions 120, 130 are made of the same thermoplastic or other flexible material, the aperture regions 120, 130 can conform to different size strings or cords. In additional embodiments, the shaft of the aperture regions 120, 130 may be formed with grooves, ridges, or rough edges to increase the resistance to a string or cord passing through, to more firmly hold the string covering apparatus in place. Alternatively, as shown on the apparatus 101 shown in FIG. 4 the aperture region shaft may be molded with other retention features, such as raised teeth 410 or other protuberances that protrude within the shaft of the aperture region, to increase the resistance thereof.

In the preferred embodiment, the material for the team logo or company emblem features in the design feature area 230 is the same flexible thermoplastic as the material of the string covering apparatus 100. To make molded features as describe above, the thermoplastic material is mixed into different colors and the desired shape for the features are cut into inserts placed in the bottom of the molds. Colored portions of the features are molded right into the part and thus will not fade. The aperture regions 120, 130 are also cut into the mold so that the entire part comes out complete. The string covering apparatus 100 and design features may be made in a variety of different colors and shapes, depending on the desired logo, emblem, mascot, or message desired to be displayed.

Alternatively, the design feature area 230 may be made flat without raised design features wherein a team logo or company emblem or the like may be, for example, printed or stamped, for example onto the front surface 115 of the central body region 110 of the string covering apparatus 100. Also, the string covering apparatus 100 may be adapted for temporary use with the use of custom-made or off-the-shelf stickers that can allow a user or producer to vary the designs displayed, thus enhancing the versatility of the string covering apparatus 100.

The string covering apparatus 100 is not limited to the shapes shown in the drawing figures. The perimeter 105 of the string covering apparatus 100 may be of irregular shape as shown in FIG. 1, may be oval or circular, or other geometric shapes. Also, the central body region 110 need not be circular as is depicted in the drawing figures. Alternative embodiments include other shapes such as oval and other geometric shapes for the central body region 110, as well as custom-made shapes. Further, the string covering apparatus 100 may have an elongated central body portion, in either the length or width direction, to cover more of a string or cord, or to accommodate more aspects of a design or logo. Further, the string covering apparatus 100 may be made in such irregular shapes as custom-made team logos, mascots, sports helmets, uniforms, hats, or company emblems. The aperture regions 120 and 130 may be arranged above and below a logo or emblem, but may also be placed on the sides, depending on the design on the string covering apparatus, and on what type of apparatus the user wants to implement the string covering apparatus 100. The dimensions of the string covering apparatus are not limited to those described above. The size of the string covering apparatus may be made larger or smaller depending on the size of the strings being used and depending on the size of the garments or carrying items. The sizes of the apertures in the aperture regions also may be adjusted for specified use.

Figure 5:
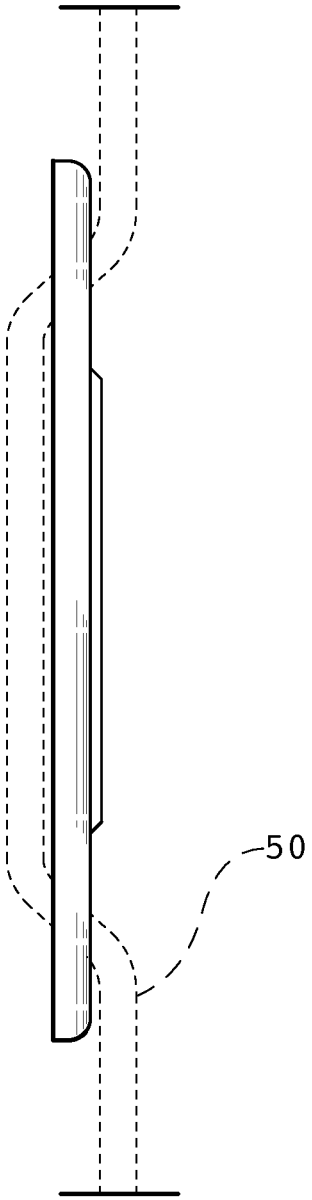
FIG. 5 is side view of the string covering embodiment of FIG. 1 with a string shown in phantom in its operable position.
Figure 6:
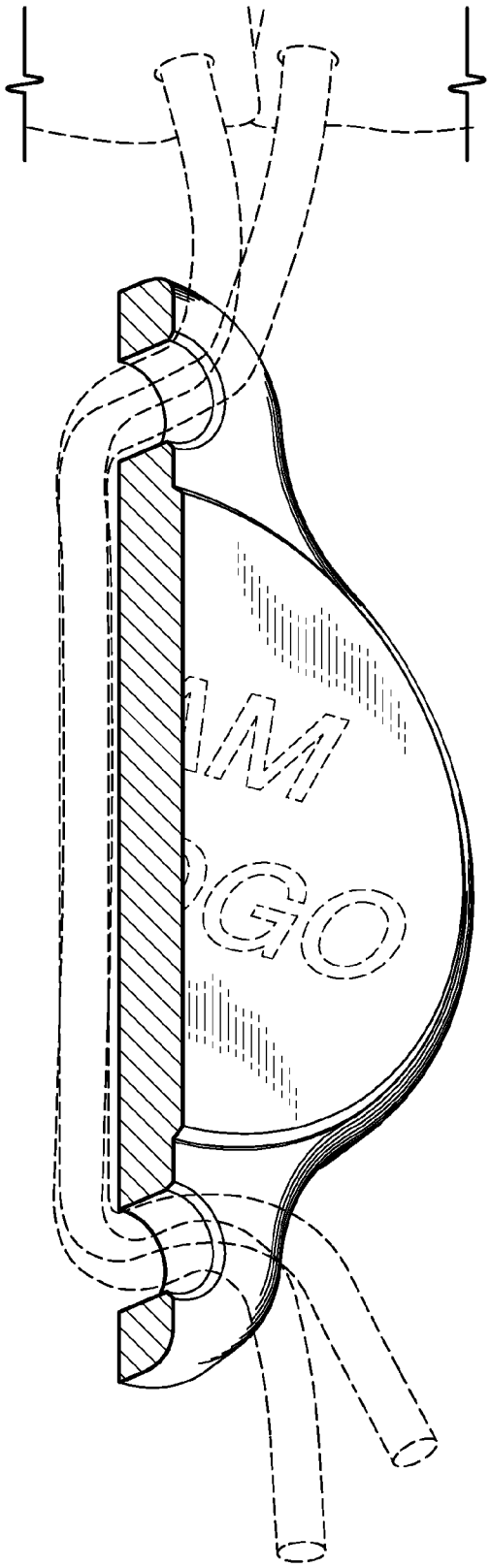
FIG. 6 is a three-dimensional section view of the string covering apparatus showing strings extending from a garment/carrying item, threaded through one of the aperture regions, passed along the back surface of the apparatus, and threaded through the second aperture region.

In use, a string or cord 50 is threaded through one of the aperture regions 120 or 130 at the front surface 115 of the string covering apparatus 100. The string or cord is then passed along the back surface 210 of the central body region 110 (as shown in FIG. 5), and then back through the second aperture region 130 or 120. Thus, the front surface 115 of central body region 110 including the design feature area 230 of the string covering apparatus 100 remains completely visible and unobstructed by the string or cord 50, and the design features remain on constant display. As described previously, the sharp edges 320 at the interface between the aperture regions 120, 130 and the back surface 210 allow the string covering apparatus 100 to remain firmly in place.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A combination string-retainer and flexible drawstring extending from a garment for preventing loss of the drawstring in the garment, the combination comprising:

(a) a substantially planar central body panel on the string-retainer, the central body panel having a front surface and a back surface;

(b) a first ear formed at one end of the central body panel, the first ear being co-planar with the central body panel and having a first aperture formed therethrough, the first aperture having a front end facing generally the same direction as the front surface of the central body panel and a back end facing generally the same direction as the back surface of the central body panel;

(c) a second ear formed at an end of the central body panel opposite the first ear, the second ear being co-planar with the central body panel and having a second aperture formed therethrough, the second aperture having a front end facing generally the same direction as the front surface of the central body panel and a back end facing generally the same direction as the back surface of the central body panel;

(d) a first end portion of the flexible drawstring extending downwardly from the garment into the front end of the first aperture, out of the back end of the first aperture, across the back surface of the central body panel, into the back end of the second aperture and out the first end of the second aperture to extend unattached beneath the central body panel;

(e) a second end portion of the flexible drawstring extending downwardly from the garment into the front end of the first aperture, out of the back end of the first aperture, across the back surface of the central body panel, into the back end of the second aperture and out the first end of the second aperture to extend unattached beneath the central body panel; and (f) a display area on the front surface of the central body panel, the display area displaying desired designs and across which no portion of the string extends;

wherein the central body panel and at least a portion of the first and second end portions that extend along the back surface of the central body panel are substantially vertically oriented with the string-retainer hanging on the first and second end portions and wherein the first and second end portions are fixed to the garment above the string-retainer and hang free below the string-retainer.

2. The combination in accordance with claim 1, further comprising a curved edge at the front end of the first aperture for string adjustment and a sharp edge at the back end of the first aperture for string retention.

3. The combination in accordance with claim 2, further comprising a curved edge at the front end of the second aperture for string adjustment and a sharp edge at the back end of the second aperture for string retention.

4. The combination in accordance with claim 3, wherein a shape of the central body panel is oval, circular, or of irregular curved shape.

5. The combination in accordance with claim 3, wherein the apertures are circularly shaped.

6. The combination in accordance with claim 3, wherein the flexible string covering apparatus is made of thermoplastic polymer.

7. A combination string-retainer and flexible drawstring extending from a carrying item for preventing loss of the drawstring in the carrying item, the combination comprising:

(a) a substantially planar central body panel on the string-retainer, the central body panel having a front surface and a back surface;

(b) a first ear formed at one end of the central body panel, the first ear being co-planar with the central body panel and having a first aperture formed therethrough, the first aperture having a front end facing generally the same direction as the front surface of the central body panel and a back end facing generally the same direction as the back surface of the central body panel;

(c) a second ear formed at an end of the central body panel opposite the first ear, the second ear being co-planar with the central body panel and having a second aperture formed therethrough, the second aperture having a front end facing generally the same direction as the front surface of the central body panel and a back end facing generally the same direction as the back surface of the central body panel;

(d) a first end portion of the flexible drawstring extending downwardly from the carrying item into the front end of the first aperture, out of the back end of the first aperture, across the back surface of the central body panel, into the back end of the second aperture and out the first end of the second aperture to extend unattached beneath the central body panel;

(e) a second end portion of the flexible drawstring extending downwardly from the carrying item into the front end of the first aperture, out of the back end of the first aperture, across the back surface of the central body panel, into the back end of the second aperture and out the first end of the second aperture to extend unattached beneath the central body panel; and (f) a display area on the front surface of the central body panel, the display area displaying desired designs and across which no portion of the string extends; and wherein the central body panel and at least a portion of the first and second end portions that extend along the back surface of the central body panel are substantially vertically oriented with the string-retainer hanging on the first and second end portions and wherein the first and second end portions are fixed to the carrying item above the string-retainer and hang free below the string-retainer.

* * * * *